US007015879B2

(12) United States Patent
Sekii

(10) Patent No.: US 7,015,879 B2
(45) Date of Patent: Mar. 21, 2006

(54) PLASMA DISPLAY PANEL DEVICE

(75) Inventor: Yoshizumi Sekii, Tokyo (JP)

(73) Assignee: Pioneer Corporation, Tokyo (JP)

( * ) Notice: Subject to any disclaimer, the term of this patent is extended or adjusted under 35 U.S.C. 154(b) by 267 days.

(21) Appl. No.: 10/206,958

(22) Filed: Jul. 30, 2002

(65) Prior Publication Data

US 2003/0020675 A1 Jan. 30, 2003

(30) Foreign Application Priority Data

Jul. 30, 2001 (JP) ..... 2001-230602

(51) Int. Cl.
*G09G 3/28* (2006.01)

(52) U.S. Cl. ..... 345/60; 315/169.4; 313/484

(58) Field of Classification Search ..... 345/37, 345/60; 315/169.1–169.4; 313/484–497

See application file for complete search history.

(56) References Cited

U.S. PATENT DOCUMENTS 6,166,711 A * 12/2000 Odake ..... 345/60
6,320,326 B1 * 11/2001 Shino et al. ..... 315/169.4
6,538,389 B1 * 3/2003 Onozawa et al. ..... 315/169.1

FOREIGN PATENT DOCUMENTS

JP 2000-89723 A 3/2000
JP 2000-294152 A 10/2000

* cited by examiner

*Primary Examiner*—Kent Chang
(74) *Attorney, Agent, or Firm*—Sughrue Mion, PLLC

(57) ABSTRACT

A plasma display panel device is provided which is capable of obtaining a uniform state of light emission for displaying and of reducing electromagnetic radiation while easily achieving a high-definition image display. The plasma display panel device includes a pair of row electrodes made up of a scanning electrode and a common electrode (sustaining electrode) which provides one display row and formed in parallel with a face of a front substrate (scanning substrate) facing a rear substrate wherein a folding-back electrode is formed on a common electrode.

9 Claims, 12 Drawing Sheets

PLASMA DISPLAY PANEL DEVICE

BACKGROUND OF THE INVENTION

1. Field of the Invention

The present invention relates to a plasma display panel device and more particularly to a plasma display panel device having a pair of row electrodes made up of a scanning electrode and a common electrode (sustaining electrode) which provide one display row formed in parallel with a plane of a front substrate (scanning substrate) facing a rear substrate.

The present application claims priority of Japanese Patent Application No. JP2001-230602 filed on Jul. 30, 2001, which is hereby incorporated by reference.

2. Description of the Related Art

A Plasma Display Panel device ((hereinafter, may be referred simply to as a PDP device) is classified into one of three types; one being an AC (Alternating Current)-type PDP device conventionally using an AC as a driving power source, another being a DC (Direct Current)-type PDP device using a DC as the driving power source, and a third being a hybrid-type PDP device using the AC and DC in combination. Of them, the AC-type PDP device is widely used since it is of a comparatively simple structure and its screen can be easily made large.

Of the AC-type PDP device, a PDP device of a three-electrode surface discharge type, in particular, has a configuration in which a pair of row electrodes made up of a scanning electrode and a common electrode which provides one display row (line) is formed in parallel with a plane of a front substrate facing a rear substrate and a column electrode (address electrode) is formed on a rear substrate so as to be orthogonal to a pair of row electrodes and, by driving the address electrode (data electrode) and the scanning electrode using a driving voltage, writing discharge is performed to select a unit cell (hereinafter being referred to as a display cell) to be turned ON (to be displayed) and then sustaining discharge is performed by surface discharge of a display cell selected by driving the scanning electrode and the common electrode using a driving voltage. In the above PDP device, since no ion bombardment causing deterioration occurs between an ion of high energy being produced on the front substrate at a time of surface discharge and a phosphor formed on the rear substrate, which enables a life to be made longer. As a result, the PDP device is widely employed.

FIG. 8 is a schematic plan view showing configurations of main components of a conventional AC-type PDP of a three-electrode surface discharging type. In the conventional AC-type PDP, as shown in FIG. 8, each of scanning electrodes 51 and each of common electrodes 52 making up a pair of row electrodes that provides one display row are formed in parallel with a row direction H on a screen, with a surface discharge gap (not shown) being put between the scanning electrode 51 and common electrode 52, on a face of a front substrate (not shown) made up of a transparent substrate that faces a rear substrate (not shown). The scanning electrode 51 includes a transparent electrode 51A and a bus electrode 51B (trace electrode) formed on a part of the transparent electrode 51A, having a resistance being lower than that of the transparent electrode 51A so as to lower a line resistance. The common electrode 52 includes a transparent electrode 52A and a bus electrode 52B (trace electrode) formed on a part of the transparent electrode 52A, having a resistance being lower than that of the transparent electrode 52A so as to lower a line resistance.

On the other hand, address electrodes 54 making up column electrodes are formed, in parallel with a column direction V on a screen, on a face (being opposite to the front substrate) of a rear substrate (not shown) made up of a transparent substrate that faces the front substrate and each of the address electrodes 54 is arranged in such a manner as to be put between ribs (partition walls) 55 each being formed in parallel with the column direction V. A display cell is partitioned by each of ribs 55 to be a plurality of display cells 56. The Plasma display panel (hereinafter, may be referred to as a PDP panel) is so constructed that the front substrate and the rear substrate are integrally assembled with space for discharging gas being put between them and, by connecting a driving circuit to the PDP panel, the AC-type PDP device is fabricated. In following descriptions, to get an easy understanding, the PDP panel alone is described simply as the AC-type PDP device.

In the AC-type PDP device having configurations described above, an arbitrary image is displayed on a screen by performing writing discharge (during an addressing period) to select a display cell 56 to be turned ON (to be displayed) out of a plurality of display cells 56 through an application of a driving voltage (high-frequency pulse) to drive the address electrode 54 and scanning electrode 51 and by performing sustaining discharge using a surface discharge method of a display cell 56 selected through an application of a driving voltage to drive the scanning electrode 51 and the common electrode 52.

FIG. 9 is a schematic plan view showing configurations of main components of the conventional AC-type PDP device. FIG. 10 is a cross-sectional view showing a method for driving the conventional AC-type PDP device. In the conventional AC-type PDP device, as shown in FIG. 9, a pair of the scanning electrode 51 and the common electrode 52 that provide one display row is formed on a display cell 59 in parallel with a line direction H in a front substrate (not shown). Each of driving terminals S1, S2, S3, . . . Sn is formed at one end (at an end on the right side in the example) of each of the scanning electrodes 51 and each of driving terminals C1, C2, C3, . . . Cn is formed at another end (at an end on the left side in the example) of each of the common electrode 52. A bus electrode 60 is connected to each of the driving terminals C1 to Cn. Moreover, as described above, the rear substrate is arranged in such a manner so as to face the front substrate in a column direction V and column electrodes (address electrodes) are formed on a face which faces the rear substrate in such a manner as to be orthogonal to the pair of the row electrodes being made up of the scanning electrode 51 and the common electrode 52.

In the configuration of the conventional AC-type PDP device shown in FIG. 9, an image is displayed, after a display cell 59 has been selected during an addressing period, by applying a high-frequency pulse of several 100 KHz to the scanning electrode 51 and the common electrode 52 for the display cell 59 selected during a sustaining discharge period to perform sustaining discharge.

Here, as shown in FIG. 9, in the conventional AC-type PDP device, the driving terminals S1 to Sn of the scanning electrode 51 are formed at an end on a right side of a PDP panel in FIG. 9 and driving terminals C1 to Cn of the common electrode 52 are formed at an end on a left side of the PDP panel in FIG. 9, each of which is positioned in a different place. Therefore, when the sustaining discharge is performed, as shown in FIG. 10, a current always flows in a same direction by the sustaining discharge through both the scanning electrode 51 and the common electrode 52 at a time when the scanning electrode 51 is driven by a first driving circuit 61 and at a time when the common electrode 52 is driven by a second driving circuit 62. As a result, a current loop 65 is formed which connects the first driving circuit 61, a GND plate 63, the second driving circuit 62, and a PDP panel 64. A loop antenna is formed by the current loop 65. Then, from this loop antenna, strong electromagnetic radiation occurs which has a frequency component in a wide band.

Since such the electromagnetic radiation has an adverse effect on electromagnetic environments in electronic devices, electric appliances, or a like in general homes, to reduce the electromagnetic radiation, it is necessary that an electromagnetic shield is provided on a PDP device. However, since a thin configuration of a PDP device is its prime selling point, such the electromagnetic shield not only hinders the thin configuration but also causes an increase in costs.

A PDP device configured so as to reduce electromagnetic radiation is disclosed in Japanese Patent Application Laid-open No. JP2000-89723 (hereinafter referred to as a first conventional technology). In the above PDP device, as shown in FIG. 11, both a scanning electrode 101 and a common electrode 102 for a first display row are drawn out from a drawing-out position on a left side 109 and both the scanning electrode 110 and the common electrode 111 for a second display are drawn out from a drawing-out position on a right side 118 and, hereinafter, the drawing-out positions of the scanning electrode and the common electrode are alternately arranged in this order for every display row. Reference numbers 119 to 121, 122 to 124, . . . show the address electrodes (for a red color, green color, and blue color). By configuring as above, since the scanning electrode 101 (110, . . . ) and common electrode 102 (111, . . . ) for each of the display rows can be drawn out in a same direction and a current produced through sustaining discharge always flows in a different direction through the scanning electrode 101 (110, . . . ) and common electrode 102 (111, . . . ), magnetic flux occurring in every unit of the display row is erased and electromagnetic radiation can be reduced.

Similarly, a PDP device is disclosed, for example, in Japanese Patent Application Laid-open No. JP2000-294152 (second conventional technology) in which magnetic flux occurring in every two display units is erased. In the disclosed conventional PDP, as shown in FIG. 12, same scanning electrodes ($SCN_1$) for the first and second display rows and same common electrode ($SUS_1$) are drawn out from a position on a left side and are connected to the scanning electrode driving circuit 200 and the sustaining electrode (common electrode) driving circuit 300, respectively. Since similar configurations for the display row below are provided, the scanning electrodes 101 (110, . . . ) and common electrodes 102 (111, . . . ) for all other display rows can be drawn out from a same direction. Moreover, reference numbers D1, D2, . . . show address electrodes to be connected to a data (address) electrode driving circuit 400.

Each of the conventional PDP devices described as the first and second technologies can reduce electromagnetic radiation, however, each of them has a problem.

First, in the first conventional technology, each of a plurality of display cells in which the scanning electrode 101 and the common electrode 102 are formed has a different impedance in every display cell due to a difference in the drawing-out position 109 on the left side of the panel caused by a positional variation in a row direction H. Therefore, since light-emitting luminance and/or controlled state are made different in every display cell, a uniform state of light emission for displaying cannot be achieved.

Next, in the second conventional technology, since magnetic flux occurring in alternating sequence of display rows is erased and potentials of the two scanning electrodes for the two display rows and of the two common electrodes for the two display rows become same, individual selection of the scanning electrode or common electrode is made impossible. Therefore, since same scanning electrodes or same electrodes can always display same contents only, high-definition display of an image becomes difficult. To solve this problem, a method may be available in which address electrodes are separated depending on either of an odd row or an even row, however, to achieve this, a very complicated driving circuit is required, which inescapably causes very high manufacturing costs.

SUMMARY OF THE INVENTION

In view of the above, it is an object of the present invention to provide a PDP device capable of obtaining a uniform state of light emission for displaying and of reducing electromagnetic radiation while easily achieving a high-definition image display.

According to a first aspect of the present invention, there is provided a PDP device including:

a front substrate and a rear substrate between which a discharging gas space is formed;

a pair of row electrodes made up of a scanning electrode and a common electrode (sustaining electrode) which provide one display row in parallel with a face of the front substrate facing the rear substrate;

a folding-back electrode on either of the scanning electrode or the common electrode for every one display row; and wherein a direction of a current flowing through the folding-back electrode and a direction of a current flowing through either of the scanning electrode or the common electrode are opposite to each other.

In the foregoing, a preferable mode is one wherein magnetic flux produced by a current flowing through the folding-back electrode and magnetic flux produced by a current flowing through either of the scanning electrode or the common electrode cancel out each other.

Also, a preferable mode is one wherein a bus electrode is connected to the common electrode.

Also, a preferable mode is one wherein an auxiliary folding-back electrode is formed on the bus electrode.

According to a second aspect of the present invention, there is provided a PDP device including:

a front substrate and a rear substrate between which a discharging gas space is formed;

a pair of row electrodes made up of a scanning electrode and a common electrode which provide one display row in parallel with a face of the front substrate facing the rear substrate;

a folding-back electrode on either of the scanning electrode or the common electrode for alternating sequence of display row; and wherein a direction of a current flowing through the folding-back electrode and a direction of a current flowing through either of the scanning electrode or the common electrode are opposite to each other.

In the foregoing, a preferable mode is one wherein magnetic flux produced by a current flowing through the folding-back electrode and magnetic flux produced by a current flowing through either of the scanning electrode or the common electrode cancel out each other.

Also, a preferable mode is one wherein a dummy electrode is formed between display rows in which the folding-back electrode is not formed.

Also, a preferable mode is one wherein each of driving terminals for the scanning electrode and common electrode is formed in every one display row.

Also, a preferable mode is one wherein each of driving terminals for the scanning electrode and common electrode is formed for alternating sequence of display rows.

With the above configurations, each of scanning electrodes and each of common electrodes making up a pair of row electrodes that provides one display row, are formed, in parallel with a row direction on a face of a front substrate facing a rear substrate and a folding-back electrode is formed on either of the common electrode or scanning electrode, and therefore the scanning electrode and the common electrode can be drawn out from a same direction of a PDP panel for at least every one display row, which can cancel magnetic flux occurring in a unit of a display row. Therefore, it is possible to obtain a uniform state of light emission for displaying and to reduce electromagnetic radiation while easily achieving a high-definition image display.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
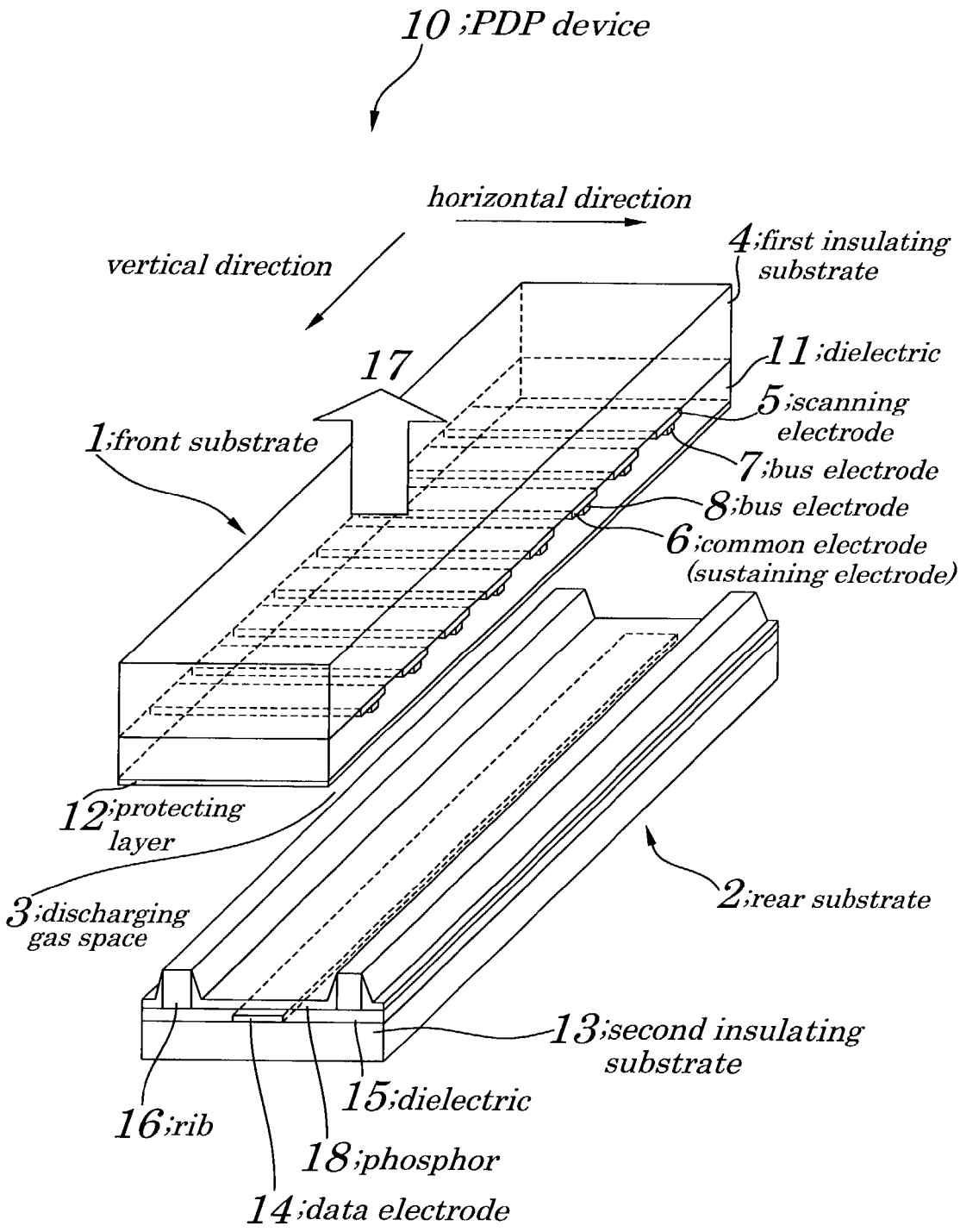
FIG. 1 is a perspective view showing configurations of a PDP device according to a first embodiment.
Figure 2:
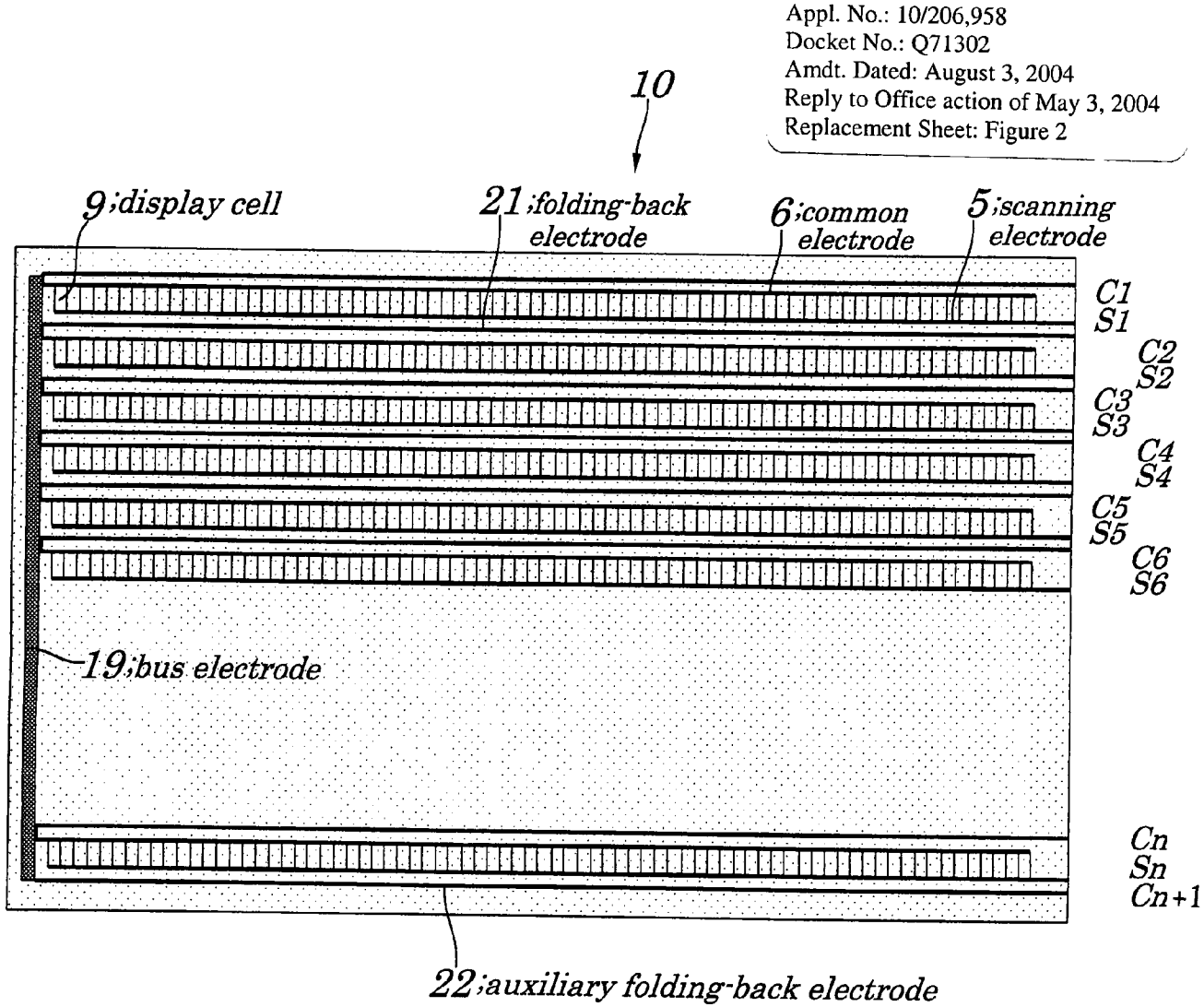
FIG. 2 is a plan view showing configurations of main components of the PDP device according to the first embodiment of the present invention.
Figure 3:
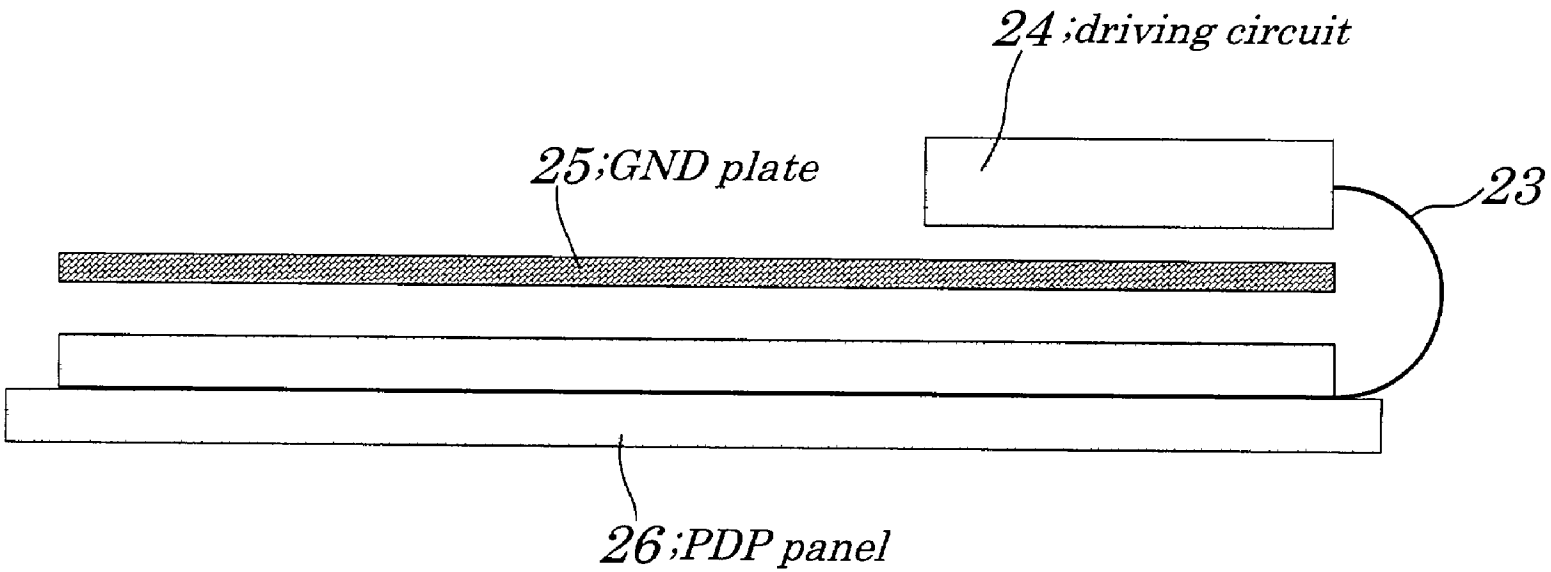
FIG. 3 is a schematic cross-sectional view illustrating a method for driving the PDP device according to the first embodiment of the present invention.

FIG. 1 is a perspective view showing configurations of a PDP device 10 of a first embodiment. FIG. 2 is a plan view showing configurations of main components of the PDP device 10 of the first embodiment. FIG. 3 is a schematic cross-sectional view illustrating a method for driving the PDP device 10 of the first embodiment. The PDP device 10 of the first embodiment, as shown in FIG. 1, has a basic configuration in which discharge gas space 3 is formed between a front substrate 1 and a rear substrate 2. The front substrate 1 includes a first insulating substrate 4 made from glass or a like, a scanning electrode 5 and a common electrode (sustaining electrode) 6 each being made from a transparent conductor such as ITO (Indium Tin Oxide) or a like and being formed on the first insulating substrate 4 in parallel with each other so as to form a pair of the scanning electrode 5 and the common electrode 6 in a horizontal direction H and to make up one display row (line), bus electrodes (trace electrodes) 7 and 8 being made of Al (Aluminum), Cu (Copper), Cr (Chromium), or a like and being formed on a part of, respectively, the scanning electrode 5 and the common electrode 6 on purpose to reduce an electric resistance, a transparent dielectric 11 containing PbO (lead oxide) covering the scanning electrode 5 (including the trace electrode 7) and common electrode 6 (including the trace electrode 8), and a protecting layer 12 being made from MgO (Magnesium oxide) or a like adapted to protect the transparent dielectric 11 from being discharged.

On the other hand, the rear substrate 2, as shown in FIG. 1, includes a second insulating substrate 13 made from glass or a like, an address (data) electrode 14 made from conductors such as Al (Aluminum), Cu (Copper), Cr (Chromium), Ag (Silver), or a like and formed on the second insulating substrate 13 in a vertical direction V so as to be orthogonal to the scanning electrode 5 and the common electrode 6, a dielectric 15 formed on the address electrode 14 so as to play a role as a reflection layer, a rib 16 made from a low melting-point glass or a like and formed in the vertical direction V in order to ensure the discharging gas space 3 and to partition a display cell, and a phosphor 18 formed in a manner that it covers the dielectric 15 and the rib 16 in order to convert ultraviolet rays having been produced by discharging to visible light 17. Moreover, to make its description easy, the front substrate 1 and rear substrate 2 are shown in a separate manner in FIG. 1. However, in an actual structure, the front substrate 1 and rear substrate 2 are formed in an integral manner in that the protecting layer 12 of the front substrate 1 contacts the rib 16 of the rear substrate 2. The discharging gas space 3 formed between the front substrate 1 and rear substrate 2 is filled with gas for discharging such as He (Helium), Ne (Neon), Xe (Xenon), or a like singly or in a mixed manner. When the PDP device 10 having such configurations is operated, the visible light 17 occurs from the front substrate 1 which is used for display.

The PDP device 10 chiefly includes, as shown in FIG. 2, the scanning electrode 5 and the common electrode 6 both being formed in parallel with each other in a row direction H on a display cell 9 in the front substrate 1 (not shown) for one display row, a bus electrode 19 is connected at a left end portion of each of the common electrodes 6, and a folding-back electrode 21 to fold back the common electrode 6 toward a right direction. Such configurations are provided for all display rows. At a right end portion of each of the folding-back electrodes 21 is formed each of driving terminals C1, C2, C3, . . . Cn. Also, at a right end of each of the scanning electrodes 5 is formed each of driving terminals S1, S2, S3, . . . Sn. At a lower end of the bus electrode 19 is formed an auxiliary folding-back electrode 22 which makes up a driving terminal Cn+1.

According to configurations of the PDP device 10 of the first embodiment, as described later, since driving terminals of the scanning electrode 5 and common electrode 6 for all display rows 9 can be drawn out from a right side direction in FIG. 2, that is, from a same direction, it is made possible to reduce electromagnetic radiation. Moreover, as described above, in a column direction V is arranged the rear substrate 2 (not shown) so as to face the front substrate 1 and on a plane facing the front substrate 1 in the rear substrate 2 are formed column electrodes (address electrodes) (not shown) in such a manner as to be orthogonal to a pair of row electrodes.

Next, operations of the PDP device 10 of the first embodiment will be described by referring to FIG. 3. First, only configurations of three electrodes including the scanning electrode 5, common electrode 6, and folding-back electrode 21, which make up one display row, are considered here. Let it be assumed that, during a sustaining discharge period, a high voltage is applied to the driving terminal S1 of the scanning electrode 5 and the driving terminal C1 of the folding-back electrode 21 being connected to the common electrode 6 is grounded. A current charging an electrostatic capacitor (not shown) existing in the display cell 9 and a current being discharged from the capacitor in the display cell 9 flow in a direction from S1 to a panel and pass through each of the display cells 9 to a common electrode 6. This current flows out from a PDP panel 26 through the folding-back electrode 21 formed on the common electrode 6 and then through the driving terminal C1 of the folding-back electrode 21 formed on the common electrode 6.

Since a current path from the driving terminals S1 to C1 is one independent root, a current flowing in from the driving terminal S1 is always equal to a current flowing out from the driving terminal C1. When it is considered that the scanning electrode 5 and common electrode 6 both being connected to each other with the display cell 9 being interposed between them make up one current path, an amount of a current flowing through the current path is always equal to that of a current flowing through the folding-back electrode 21 formed on the common electrode 6 and directions of the flow of the currents are opposite to each other. The magnetic fluxes induced by each of the currents cancel each other out. In the PDP device 10 shown in FIG. 2, a required number of display rows having such actions described above is arranged.

Next, effects that can be achieved by the PDP device 10 of the first embodiment are explained. As described above, when the folding-back electrode 21 is formed, since magnetic fluxes induced by a driving current for every one unit of a display row cancel each other out, it is made possible to extremely reduce electromagnetic radiation providing a source of a magnetic flux. Since this is an effect that can be achieved by an electrode structure making up the PDP device 10, no change in a method employed in the driving circuit is required and the effect can be obtained not only during a sustaining discharge period but also in all operations in which a current flows through a PDP panel.

Therefore, a stringent electromagnetic shield which has been indispensable to the PDP device as a product is not required and it is possible to reduce costs of the PDP device and to make it lightweight and to prevent an electromagnetic environment in space provided in general homes from becoming worse. Moreover, even if a distance from each of the driving electrodes in the scanning electrode 5 or in the common electrode 6 is different, since a total sum of a length of each of the driving electrode for an arbitrary display cell is same and since a uniform impedance is given to any display cell 9, a state of control on light emission luminance or on a display cell in every display cell 9 becomes same when a distance from a driving terminal of the scanning electrode 5 or common electrode 6 of the PDP panel 26 is large or small, a uniform state of light emission for displaying can be obtained.

Moreover, since the scanning electrode 5 is so configured as to be one independent electrode for every display row, a display being different for every display row can be easily achieved. Therefore, it is possible to provide a PDP device having an electrode structure being capable of reducing electromagnetic radiation, of obtaining a uniform state of light emission for displaying in the PDP panel 26, and of easily scanning and selecting an independent display content for every display row.

Moreover, according to the PDP device 10 of the first embodiment, as shown in FIG. 3, a current loop 23 caused by sustaining discharge is terminated at a driving circuit 24 placed at one side of the PDP panel 26. Therefore, unlike in the conventional technology, since the current loop 23 is not formed through a GND plate 25, a GND plate 25 used to flow a large high-frequency current is not required and, as a result, it is made possible to reduce costs and lightweight.

Moreover, according to the PDP device 10 of the first embodiment, since a bus electrode 19 is formed on the common electrode 6 and all the common electrodes 6 are grounded in the PDP panel 26, a potential of the common electrode 6 in the PDP panel 26 can be once made uniform. Even if paths being grounded from a driving circuit are not uniform in impedance for a driving terminal of the folding-back electrodes 21 formed on all common electrodes 6, it is possible to prevent an unevenness in light-emitting luminance. Moreover, even if impedance of a path being connected from a driving circuit is not uniform for the driving terminal of the folding-back electrode 21 formed on all the common electrodes 6 or even if a number of the display cells 9 used to perform sustaining discharge for a display row is largely different, it is possible to prevent an unevenness in light-emitting luminance among display rows. Here, if no bus electrode 19 is provided, an increase in impedance for the display cell 9 caused by addition of the folding-back electrode 21 independently affects one display row and, in the display row having a larger number of the display cells 9 used to perform sustaining discharge, a drop in voltage becomes larger and, as a result, an unevenness in the light emission luminance occurs. Thus, an effect can be obtained in which the bus electrode 19 prevents deterioration in an image quality of a display.

When a variation in light emission luminance among display rows by forming the bus electrode 19 is to be prevented, a current required for light emission discharge has to be larger in the display row having the larger number of display cells 9 used to perform sustaining discharge and is supplied additionally through the bus electrode 19 from the folding-back electrode 21 formed on the common electrode 6 making up a display row having a small number of the display cell 9 being adjacent to each other and being used to perform sustaining discharge. Therefore, when only one display row is considered, in some cases, an amount of a current flowing through one current path formed on the scanning electrode 5 and the common electrode 6 both being connected with the display cell 9 being interposed between them is not equal to an amount of a current flowing through the folding-back electrode 21 formed on the common electrode 6 in a direction opposite to each other. However, when a plurality of display rows being adjacent to each other is considered, a total sum of currents flowing in a direction opposite to each other becomes equal to each other. Moreover, in the case of high-frequency components in which radiation of an electro-magnetic noise increases more, since an action by mutual inductance becomes stronger, a current for light emission discharge provides a characteristic that an equal amount of the current flows through the folding-back electrodes 21 being nearer to each other. Therefore, even if the bus electrode 19 is formed, an effect is not impaired which can cancel magnetic flux occurring due to a driving electrode and can reduce extremely electromagnetic radiation providing a source of a magnetic field.

Moreover, according to the first embodiment, as shown in FIG. 2, consistency in configurations of the PDP device 10 can be achieved in that, since auxiliary folding-back electrodes 22 formed on the common electrode 6 are formed, all the scanning electrode 5 and the common electrode 6 being connected through the display cell 9, which make up all the display rows, are always put between the two folding-back electrodes 21 formed on the common electrode 6 being placed up and down. Therefore, only one display row having no auxiliary folding-back electrode 22 formed on the common electrode 6, since it is affected less by an action of mutual inductance than other display rows, can prevent a detriment such as a decrease in light emission luminance or a like caused by increased inductance occurring in a series of a current path.

In a go-and-return path for a current being so configured that magnetic flux is cancelled out, it is known that its inductance becomes very small which can be same in configurations of the electrodes used in the PDP device 10 of the present invention. This makes small inductance of an electrode for various driving pulses fed from a driving circuit and, as a result, a voltage surge occurring at a transient of a pulse or at a time of switching of a current path in the driving circuit can be made smaller. Therefore, this enables lowering of a rating of a withstand voltage of a switching element in the driving circuit and can give an effect of reducing electromagnetic radiation occurring as emission providing a source of an electric field.

Moreover, it is desirable that a rib (not shown) is provided along the folding-back electrode 21 formed on the common electrode 6. This can prevent discharging that should occur only between the scanning electrode 5 and the common electrode 6 from occurring between the scanning electrode 5 and the folding-back electrode 21 formed on the common electrode 6. Moreover, in the first embodiment, as a means for preventing a variation of light emission luminance, though the bus electrode 19 and the auxiliary folding-back electrode 22 formed on the common electrode 6 are formed, in order to reduce much of the electromagnetic radiation, the auxiliary folding-back electrode 22 is not always necessary. If there is no bus electrode 19, the scanning electrode 5 may serve also as the folding-back electrode 21. Moreover, it is not always necessary that one folding-back electrode 21 is formed in every one display row. The folding-back electrode 21, as shown in FIG. 2, without being formed on one plane, may be multi-layer structured and may be formed in three dimensions.

Thus, according to the PDP device 10 of the first embodiment, in the configuration in which each of scanning electrodes 5 and each of common electrodes 6, both of which make up a pair of row electrodes that provide one display row, are formed, in parallel with a row direction on a screen on a face of the front substrate 1 that faces the rear substrate 2, since the folding-back electrode 21 is formed on the common electrode 6, the scanning electrode 5 and common electrode 6 can be drawn out from a same direction of the PDP panel 26 and, therefore, magnetic flux occurring in a unit of a display row can be cancelled. Therefore, it is possible to obtain a uniform state of light emission for displaying and to reduce electromagnetic radiation while easily achieving high-definition image display.

Second Embodiment

Figure 4:
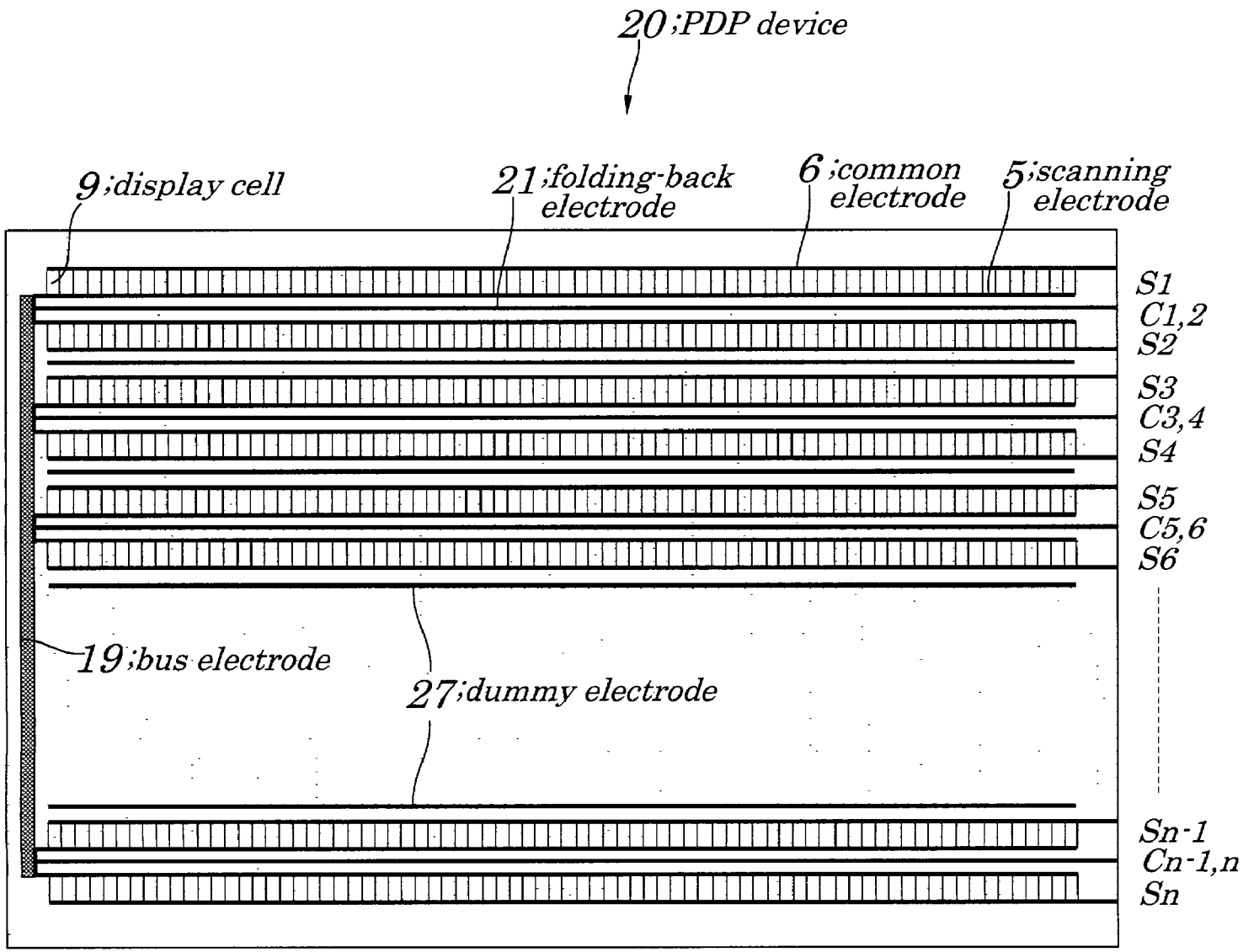
FIG. 4 is a plan view showing configurations of main components of a PDP device according to a second embodiment of the present invention.

FIG. 4 is a plan view showing configurations of main components of a PDP device 20 of a second embodiment of the present invention. Configurations of the PDP device 20 of the second embodiment differ greatly from those in the first embodiment in that a folding-back electrode 21 is formed for alternating sequence of display rows. That is, in the PDP device 20 of the second embodiment, as shown in FIG. 4, a bus electrode 19 is connected to a common electrode 6 at a left end of a PDP panel which is used commonly by other common electrodes 6, and the folding-back electrode 21 to fold back the common electrode 6 to a right direction. At a right end of each of the folding-back electrodes 21 is formed each of driving terminals C1, C2, C3, . . . Cn. Moreover, at a right end of the scanning electrode 5 is formed each of the driving terminals S1, S2, S3, . . . Sn. In such the configurations, electrodes are arranged in a manner being symmetric with respect to the folding-back electrode 21 formed on the common electrode 6. Moreover, a dummy electrode 27 is mounted between display rows where the folding-back electrode 21 of the common electrode 6 is not formed. Driving circuits 24 are put together on one side where panel driving terminals are formed, as in the case of the first embodiment shown in FIG. 3. In the driving circuit 24, the driving terminals C1 to Cn+1 of the folding-back electrode 21 formed on the common electrodes 6 in FIG. 4 are so configured as to be all connected and to be handled as one terminal.

Next, operations of the PDP device 20 of the second embodiment will be described.

First, let it be assumed that only five electrodes are now considered which include a scanning electrode 5 on a first line and a common electrode 6 with a display cell 9 being put between the scanning electrode 5 and common electrode 6 on which a folding-back electrode 21 is formed, a common electrode 6 on a second line and a scanning electrode 5 with a display cell 9 being put between the common electrode 6 and scanning electrode 5. Also, let it be assumed that, during a sustaining discharge period, the driving terminals S1 and S2 of the scanning electrode 5 are connected to a same terminal for a high voltage and the driving terminal C1 and C2 of the folding-back electrode 21 being connected to the common electrode 6 are grounded. A current used to charge an electrostatic capacitor (not shown) existing in the display cell 9 and a current produced by discharge of the display cell 9 flow in the PDP panel 26 from the driving terminals S1 and S2 and passes through each of the display cells 9 for the two display rows to each of the common electrodes 6. This current, after having passed through one folding-back electrode 21 of the common electrode 6, flows out from the PDP panel 26 through the driving terminals C1 and C2 of the folding-back electrode 21 of the common electrode 6.

Since a current path existing between the driving terminals S1 and S2 and driving terminals C1 and C2 is one independent route, a total sum of an amount of a current flowing from the driving terminals S1 and S2 and an amount of a current flowing out from the driving terminals C1 and C2 always become equal to each other. When the scanning electrode 5 and the common electrode 6 with the display cell 9 being put between the scanning electrode 5 and the common electrode 6 are considered to be a current path, a total sum of an amount of a current flowing through the current path for the two display rows and an amount of currents flowing through one folding-back electrode 21 formed on the common electrode 6 are always same and their flowing directions are opposite to each other. Then, the magnetic fluxes induced by each of the currents cancel each other out. Same occurs also when a voltage applied to the driving terminal is reversed. That is, the magnetic fluxes induced by each of the currents cancel each other out in alternating sequence of display rows.

In the second embodiment, when sustaining discharge or preliminary discharge, in which a voltage pulse is applied to a whole of the PDP panel 26, occurs, currents between the electrodes without the display cell 9 being put between the electrodes being adjacent to each other becomes equal. Since both the electrodes being adjacent to each other in an up-and-down direction of the folding-back electrode 21 formed on the common electrode 6 are the common electrodes 6, these three electrodes are at a same potential and since both the electrodes being adjacent to each other in an up-and-down direction with the dummy electrode 27 being put between the electrodes are the scanning electrodes 5, these three electrodes including the dummy electrode 27 being electrically floated are at a same potential. Therefore, since electrostatic capacitance other than that produced in the display cell 9 can be neglected, reduction of amounts in currents used to drive the PDP panel 26 is made possible. As a result, effects of reducing a driving capacity of a driving circuit or of reducing power consumption occurring by charging or discharging of electrostatic capacitors can be achieved.

Moreover, since currents between the electrodes without the display cell 9 being put between the electrodes, being adjacent to each other, becomes equal, a problem associated with a distance between electrodes which is required to satisfy requirements for a dielectric strength is solved which enables its distance to be reduced. As a result, since an interval between the scanning electrode 5 and common electrode 6 that overlay the display cell 9 can be made wide, an effect of taking out more light emitted by the display cell 9 can be achieved.

Furthermore, in the second embodiment, as shown in FIG. 4, the dummy electrode 27 is formed between the display rows for which the folding-back electrode 21 formed on the common electrode 6 is not formed. If electrodes are seen on a display screen, regardless of whether they have a characteristic of reflecting light or absorbing light, visual inconsistencies in an amount of reflected light or absorbed light caused by a difference in density of an electrode depending on existence of the folding-back electrode 21 of the common electrode 6 being put between the display rows. Therefore, the existence of the dummy electrode 27 can provide an effect of reducing such visual inconsistencies as described above. Moreover, in the second embodiment, as a measure for preventing inconsistencies in light emission luminance, as in the case of the first embodiment, the bus electrode 19 is formed, however, in order to minimize electromagnetic radiation, the bus electrode 19 is not always required. Moreover, the folding-back electrode 21 formed on the common electrode 6, as shown in FIG. 4, without being formed on one plane, may be multi-layer structured and in three dimensions. In this case, if the display screen on the folding-back electrode 21 formed on the common electrode 6 has no visual influence, the dummy electrode 27 is not required.

Furthermore, it is preferable that a rib (not shown) is formed along the folding-back electrode 21 formed on the common electrode 6 and the dummy electrode 27. By configuring the PDP device 20 of the second embodiment in a manner as described above, it is possible to prevent a discharge that should occur only between the scanning electrode 5 and common electrode 6 from occurring between the scanning electrode 5 and the folding-back electrode 21 formed on the common electrode 6. By configuring the PDP device 20 so that both a surface on a display screen side of the rib and a surface on a display screen side of the folding-back electrode 21 formed on the common electrode 6 have colors being visually equal to each other, the dummy electrode 27 is not required.

Thus, in the PDP device 20 of the second embodiment, instead of the folding-back electrode 21 formed in every display row, the folding-back electrode 21 is formed in alternating sequence of display rows and therefore approximately the same effect as obtained in the first embodiment can be achieved.

Third Embodiment

Figure 5:
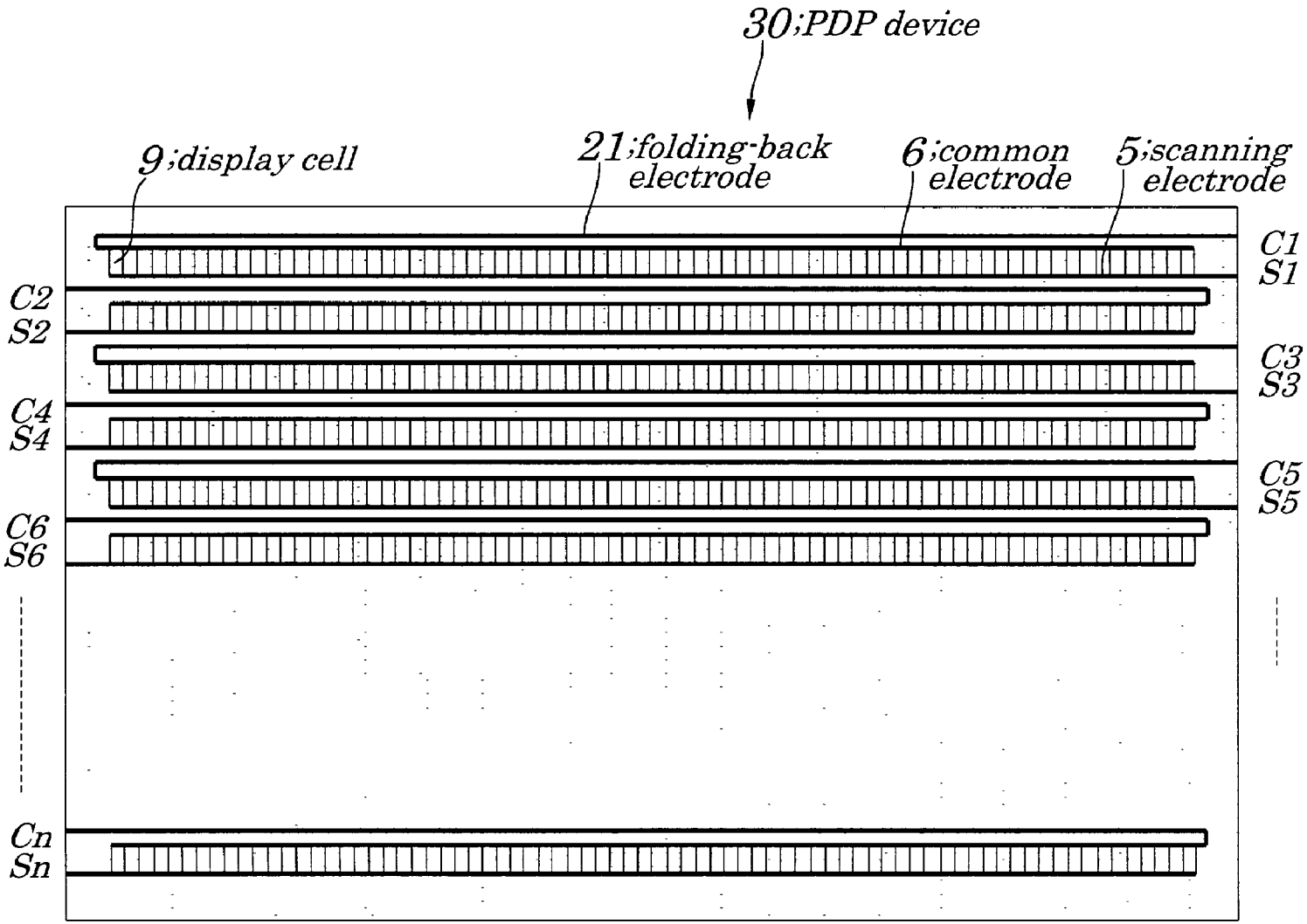
FIG. 5 is a plan view showing configurations of main components of a PDP device according to a third embodiment of the present invention.
Figure 6:
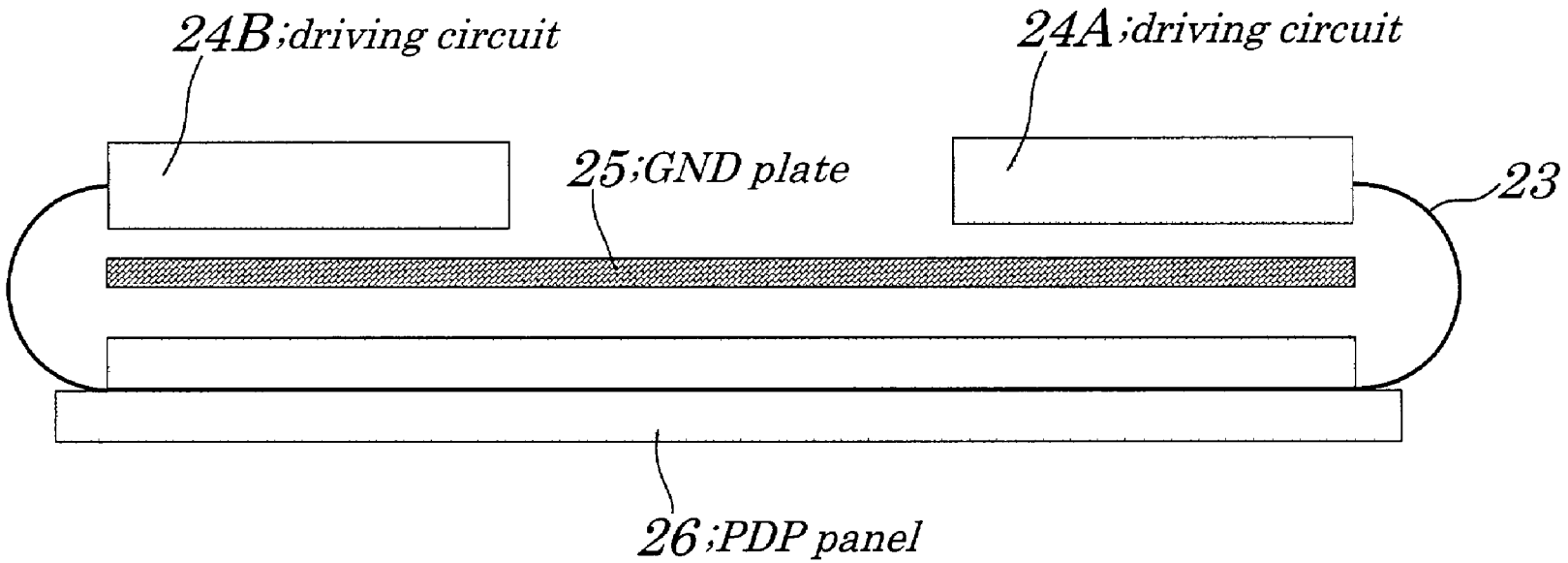
FIG. 6 is a schematic cross sectional view showing a method for driving the PDP device according to the third embodiment of the present invention.

FIG. 5 is a plan view showing configurations of main components of a PDP device 30 according to a third embodiment of the present invention. FIG. 6 is a schematic cross sectional view showing a method for driving the PDP device 30 according to the third embodiment. Configurations of the PDP device 30 of the third embodiment of the present invention differ greatly from configurations of the first embodiment in that each of the driving terminals of a scanning electrode 5 and a common electrode (sustaining electrode) is formed in a different direction for every one display row. That is, as shown in FIG. 5 and FIG. 6, in the PDP device 30 of the third embodiment, in the case when it is difficult to draw out each of driving terminals S1 to S2 and C1 and Cn of the scanning electrode 5 and a common electrode 6, respectively, from a same direction because of space constraints, these terminals are alternately formed at right end portions and left end portions for every one display row. Moreover, a driving circuit 24B is formed on one end of a PDP panel 26 and a driving circuit 24A is formed on another end of the PDP panel 26 separately to correspond to a direction in which each of the driving terminals S1 and S2 and C1 and Cn is drawn out.

By configuring as described above, even if space constraints exist, since a number of the driving terminal formed on one side of the PDP panel 26 becomes approximately a half of the number of the driving terminals formed in the first embodiment and therefore an interval between positions for forming the driving terminal can be made wide, it is possible to ensure reliability of connection. Moreover, a driving capability and a number of scanning outputs of the driving circuits 24A and 24B being placed on both the sides of the PDP panel 26 also become a half, a problem that it is difficult to put the driving circuit fully together on one side can be solved. Moreover, as shown in FIG. 6, since a current route 23 can be terminated at the driving circuits 24A and 24B each being placed at one and the other ends of the PDP panel 26, a current loop is not formed through a GND plate 25. As a result, the GND plate 25 used to flow a large high frequency current is not required which makes it possible to reduce costs of the PDP device 30 or to make it lightweight. Configurations other than those described above are approximately same as those in the first embodiment and, in FIG. 5 and FIG. 6, same reference numbers are assigned to parts having same functions of those in FIG. 2 and FIG. 3 and their descriptions are omitted accordingly.

Thus, in the configurations of the PDP device 30 of the third embodiment, the same effect as obtained in the first embodiment can be achieved.

Fourth Embodiment

Figure 7:
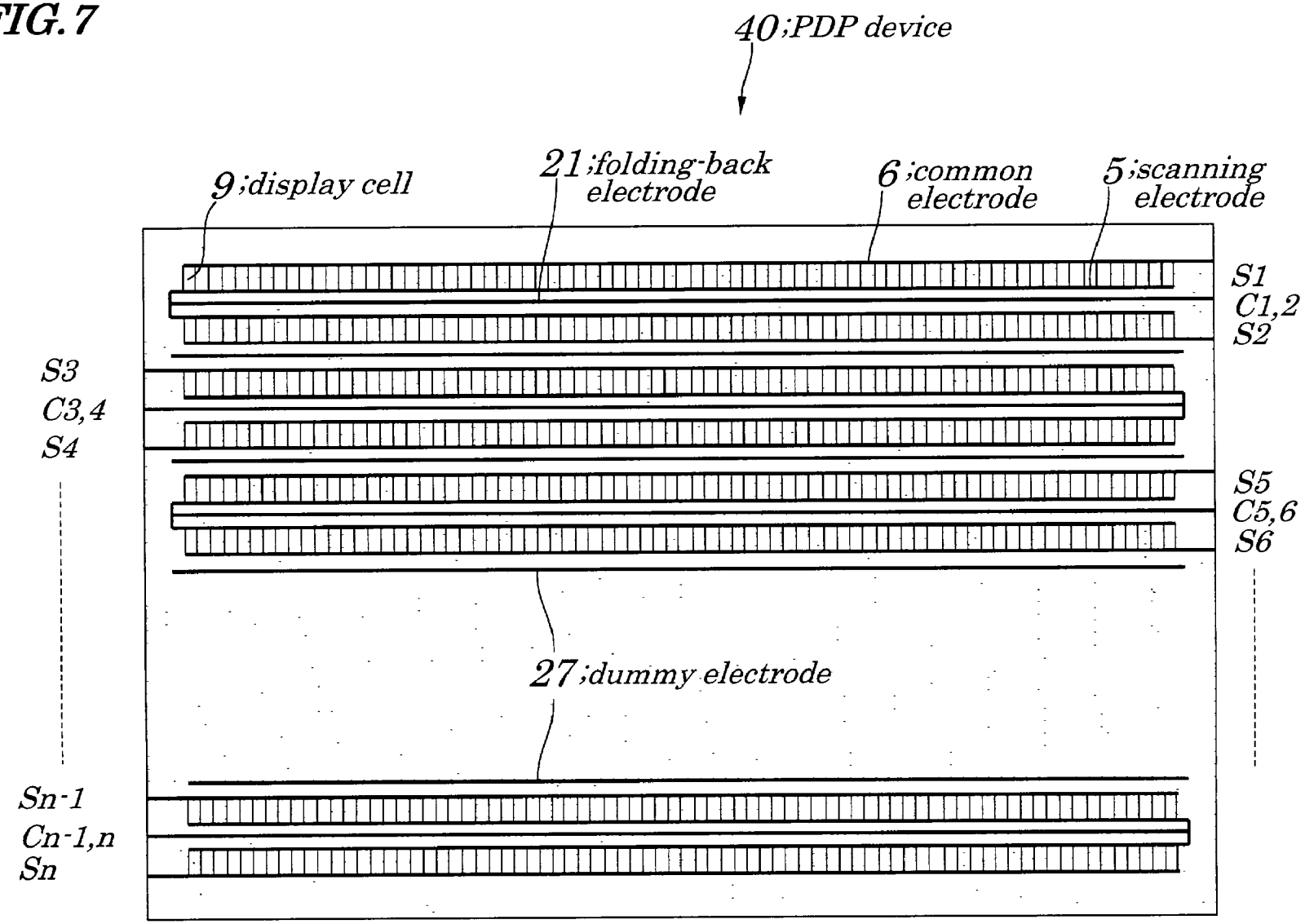
FIG. 7 is a plan view showing configurations of main components of a PDP device according to a fourth embodiment of the present invention.
Figure 8:
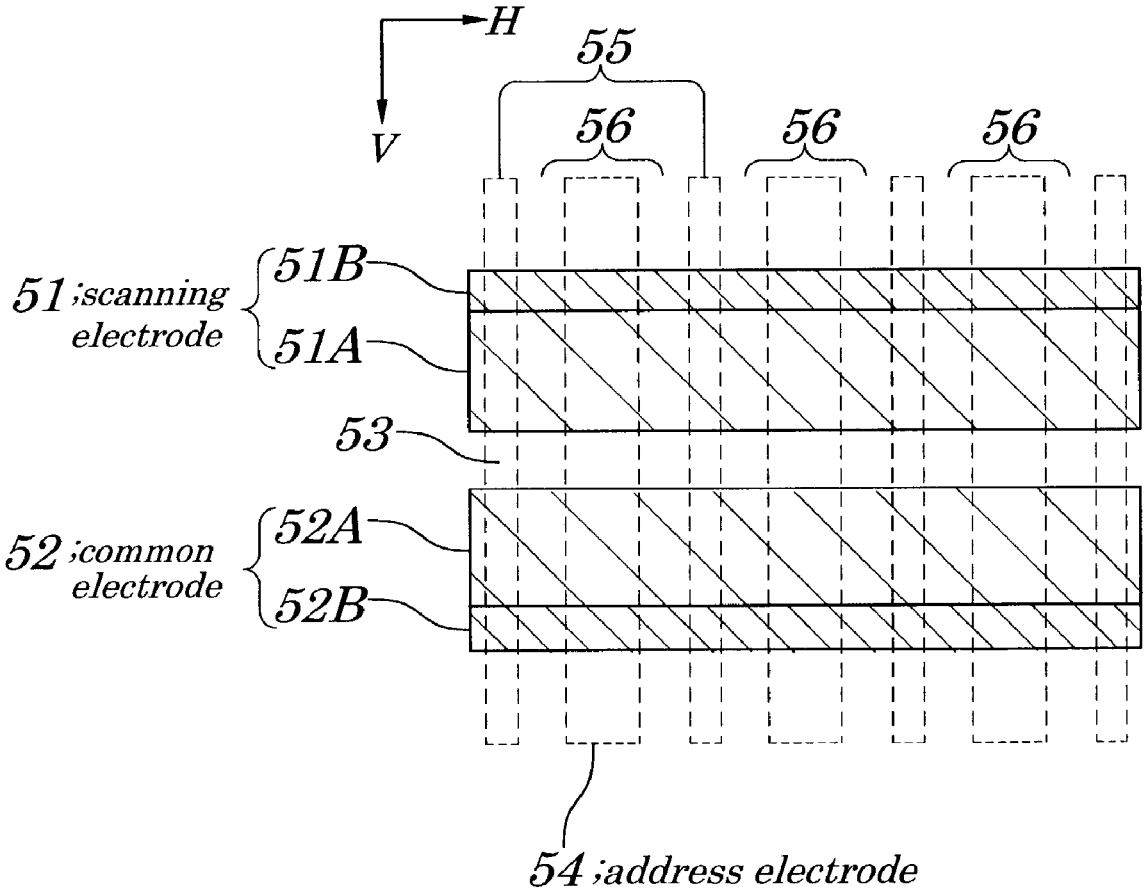
FIG.8(PRIOR ART)
FIG. 8 is a schematic plan view showing configurations of main components of a conventional AC-type PDP device of a three electrode surface discharging type.
Figure 9:
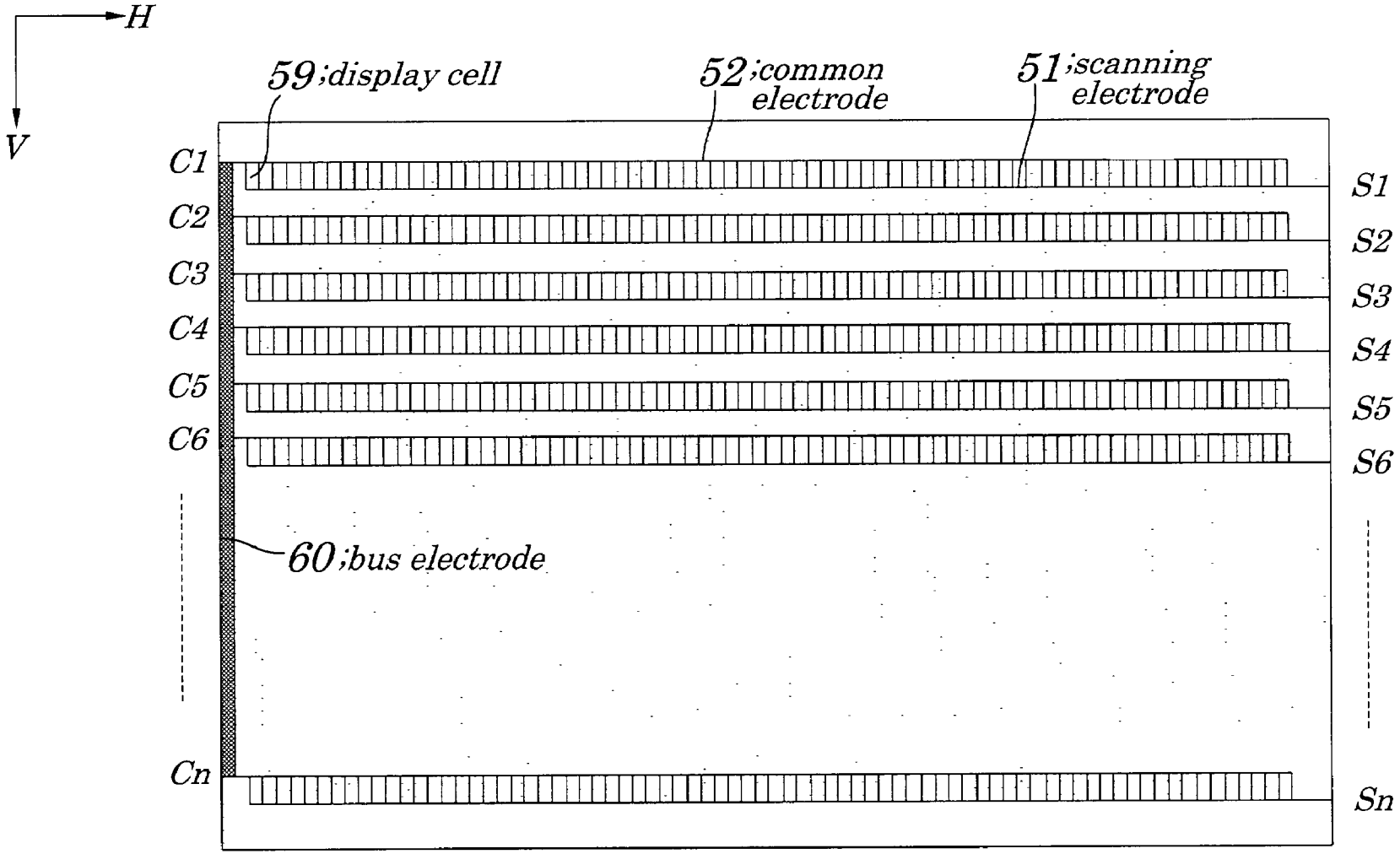
FIG.9(PRIOR ART)
FIG. 9 is a schematic plan view showing configurations of main components of the conventional AC-type PDP device.
Figure 10:
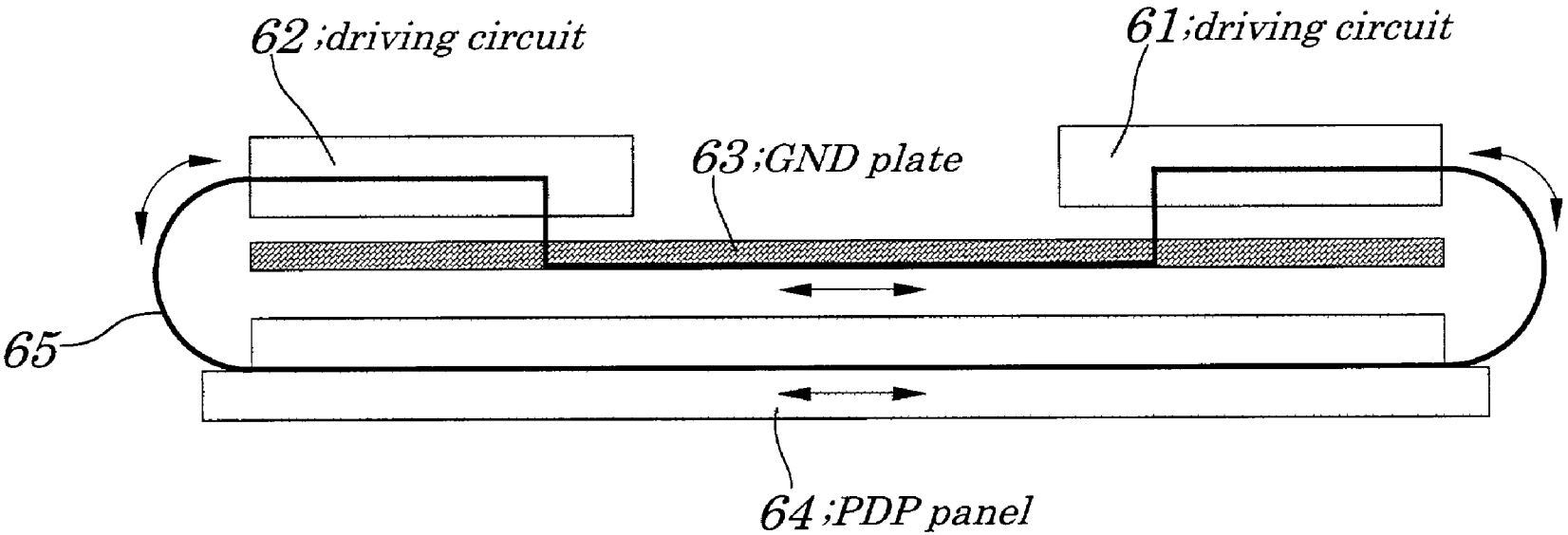
FIG.10(PRIOR ART)
FIG. 10 is a cross-sectional view showing a method for driving the conventional AC-type PDP device.
Figure 11:
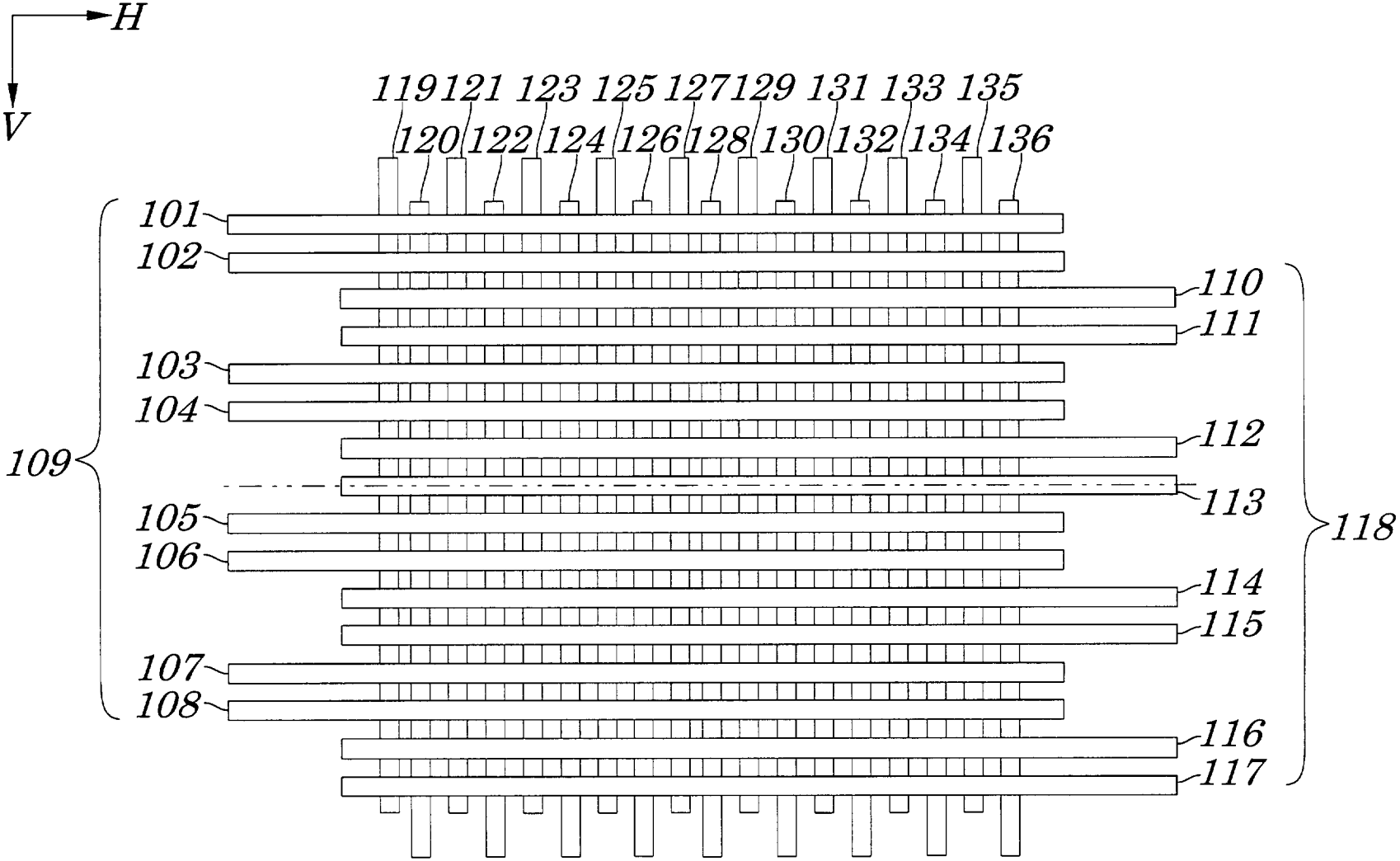
FIG.11(PRIOR ART)
FIG. 11 is a plan view showing configurations of main components of the conventional AC-type PDP device.
Figure 12:
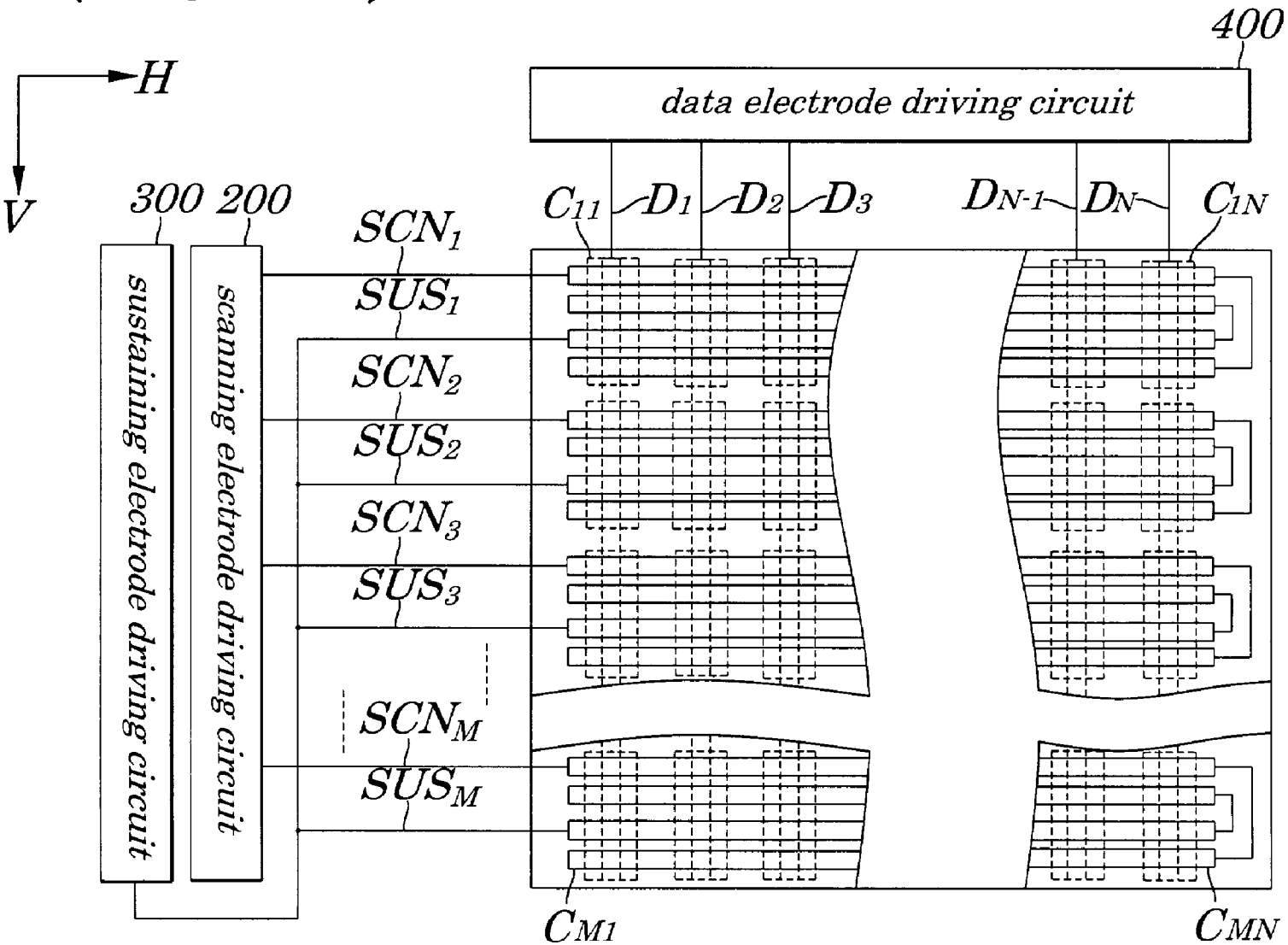
FIG.12(PRIOR ART)
FIG. 12 is a plan view showing configurations of main components of the conventional AC-type PDP device.

FIG. 7 is a plan view showing configurations of main components of a PDP device 40 according to a fourth embodiment of the present invention. Configurations of the PDP device 40 of the fourth embodiment differ greatly from those in the second embodiment in that each of driving terminals of a scanning electrode 5 and sustaining electrode is formed in a different direction for alternating sequence of display rows. That is, as shown in FIG. 7, in the PDP device 40 of the fourth embodiment, in the case when it is difficult to draw out each of driving terminals S1 to S2 and C1 and Cn of the scanning electrode 5 and of a common electrode 6, respectively, from a same direction because of space constraints, these terminals are alternately formed at right end portions and left end portions for every one display row. A cross sectional view of the PDP device 40 of the fourth embodiment is same as that shown in FIG. 6 and therefore components having same reference numbers shown in FIG. 6 are employed in the fourth embodiment. As in the case of the third embodiment, one driving circuit is formed on one end of a PDP panel 26 and another driving circuit is formed on an other end of the PDP panel 26 separately to correspond to a direction in which each of the driving terminals S1 and S2 and C1 and Cn is drawn out.

By configuring as above, even if there are space restraints, since a number of driving terminals formed on one side of the PDP panel 26 becomes approximately a half of that in the first embodiment, an interval between positions for forming the driving terminal can be made wide and, as a result, it is possible to ensure reliability of connection. Moreover, a driving capability and a number of scanning outputs of the driving circuits 24A and 24B each being placed on one side of the PDP panel 26 also become a half, a problem that it is difficult to put the driving circuit fully together on one side can be solved. Moreover, since a current route 23 can be terminated at the two driving circuits 24A and 24B each being placed at one side of the PDP panel 26, a current loop is not formed through a GND plate 25. As a result, the GND plate 25 used to flow a large high-frequency current is not required, which makes it possible to reduce costs of the PDP device 40 or to make it lightweight.

Configurations other than those described above are approximately same as those in the first embodiment and, in FIG. 7, same reference numbers are assigned to parts having same functions of those in FIG. 4 and their descriptions are omitted accordingly.

Thus, in the configurations of the fourth embodiment, the same effect as obtained in the second embodiment can be achieved.

It is apparent that the present invention is not limited to the above embodiments but may be changed and modified without departing from the scope and spirit of the invention. For example, in the above embodiments, a folding-back electrode is formed on a common electrode, however, the folding-back electrode may be formed on a scanning electrode. Moreover, each of driving terminals for a scanning electrode and common electrode shown in the above embodiment can be drawn from either of right end portions or left end portions. All that is needed in the present invention is that each of the driving terminals for the scanning electrode and common electrode is drawn from a same direction of a panel for, at least, one display row.

What is claimed is:

1. A plasma display panel device comprising:

a front substrate and a rear substrate between which a discharging gas space is formed;

a display row in parallel with a face of said front substrate facing said rear substrate comprising a pair of row electrodes made up of a scanning electrode and a common electrode; and a folding-back electrode formed on either of said scanning electrode or said common electrode for every one display row such that a direction of a current flowing through said folding-back electrode and a direction of a current flowing through either of said scanning electrode or said common electrode are substantially opposite to each other, wherein said folding-back electrode is not a row electrode.

2. The plasma display panel device according to claim 1, wherein said folding-back electrode is disposed such that a magnetic flux produced by a current flowing through said folding-back electrode and a magnetic flux produced by a current flowing through either of said scanning electrode or said common electrode substantially cancel each other out.

3. The plasma display panel device according to claim 1, wherein a bus electrode is connected to said common electrode.

4. The plasma display panel device according to claim 3, wherein an auxiliary folding-back electrode is formed on said bus electrode.

5. The plasma display panel device according to claim 1, wherein each of driving terminals for said scanning electrode and common electrode is formed in every one display row.

6. A plasma display panel device comprising:

a front substrate and a rear substrate between which a discharging gas space is formed;

a pair of row electrodes made up of a scanning electrode and a common electrode which provide one display row in parallel with a face of said front substrate facing said rear substrate; and a folding-back electrode formed on either of said scanning electrode or said common electrode for alternating sequence of display row such that a direction of a current flowing through said folding-back electrode and a direction of a current flowing through either of said scanning electrode or said common electrode are substantially opposite to each other, wherein said folding back electrode is not a row electrode.

7. The plasma display panel device according to claim 6, wherein said folding-back electrode is disposed such that a magnetic flux produced by a current flowing through said folding-back electrode and a magnetic flux produced by a current flowing through either of said scanning electrode or said common electrode substantially cancel each other out.

8. The plasma display panel device according to claim 6, wherein a dummy electrode is formed between display rows in which said folding-back electrode is not formed.

9. The plasma display panel device according to claim 6, wherein each of driving terminals for said scanning electrode and common electrode is formed in alternating sequence of display rows.

* * * * *